United States Patent [19]

Aizawa et al.

[11] 4,430,410

[45] Feb. 7, 1984

[54] METHOD AND APPARATUS FOR DEVELOPING LATENT ELECTROSTATIC IMAGES

[75] Inventors: Tatsuo Aizawa, Osaka; Shoji Matsumoto, Neyagawa; Kaoru Sakata, Hirakata; Toshikazu Matsui, Kishiwada; Akira Fushida, Suita; Toshimitsu Ikeda, Himeji; Nobuyoshi Hisao, Neyagawa, all of Japan

[73] Assignee: Mita Industrial Co., Ltd., Osaka, Japan

[21] Appl. No.: 70,052

[22] Filed: Aug. 27, 1979

[51] Int. Cl.[3] ..... G03G 13/09

[52] U.S. Cl. ..... 430/122; 430/120; 430/903

[58] Field of Search ..... 427/14.1; 355/300; 430/120, 122; 118/644, 656, 657, 658

[56] References Cited

U.S. PATENT DOCUMENTS

| | | | |
|---|---|---|---|
| 2,976,144 | 3/1961 | Rose | 430/97 |
| 3,093,039 | 6/1963 | Rheinfrank | 430/124 |
| 3,166,419 | 1/1965 | Gundlach | 430/126 |
| 3,166,432 | 1/1965 | Gundlach | 430/126 |
| 3,639,245 | 2/1972 | Nelson | 430/903 |
| 3,645,770 | 2/1972 | Flint | 430/120 |
| 3,909,258 | 9/1975 | Kotz | 430/122 |
| 4,034,709 | 7/1977 | Fraser et al. | 355/3 DD |
| 4,081,571 | 3/1978 | Nishihama et al. | 430/120 |

FOREIGN PATENT DOCUMENTS

| | | |
|---|---|---|
| 491-62 | 5/1959 | Japan . |
| 492-62 | 5/1959 | Japan . |
| 20695-63 | 5/1959 | Japan . |
| 49-5035 | 1/1974 | Japan . |
| 50-45639 | 4/1975 | Japan . |

*Primary Examiner*—John E. Kittle
*Assistant Examiner*—John L. Goodrow
*Attorney, Agent, or Firm*—Wenderoth, Lind & Ponack

[57] ABSTRACT

In a method and apparatus for developing a latent electrostatic image formed on the surface of an image-bearing material by applying a powdery developer thereto, which includes magnetically retaining a layer of a relatively conductive one-component developer having a resistivity of not more than $10^{13}$ ohms-cm on the surface of a developer-retaining member, and bringing the developer on the surface of the developer-retaining member into contact with the surface of the image bearing material, the improvement wherein the developer-retaining member has a resistance, measured by a point-plane resistance measuring method in an environment kept at a temperature of 20° C. and a humidity of 50%, of from $3\times10^{7}$ ohms to $1\times10^{10}$ ohms. The improved method makes possible good development without causing a background fog or a tail effect.

10 Claims, 6 Drawing Figures

FIG. 4-A
PRIOR ART

FIG. 4-B
PRIOR ART

FIG. 3-A
PRIOR ART
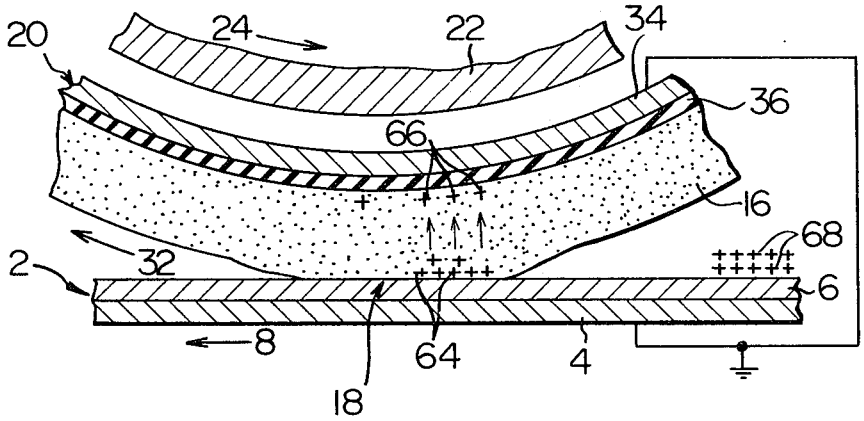
FIG. 3-B
PRIOR ART
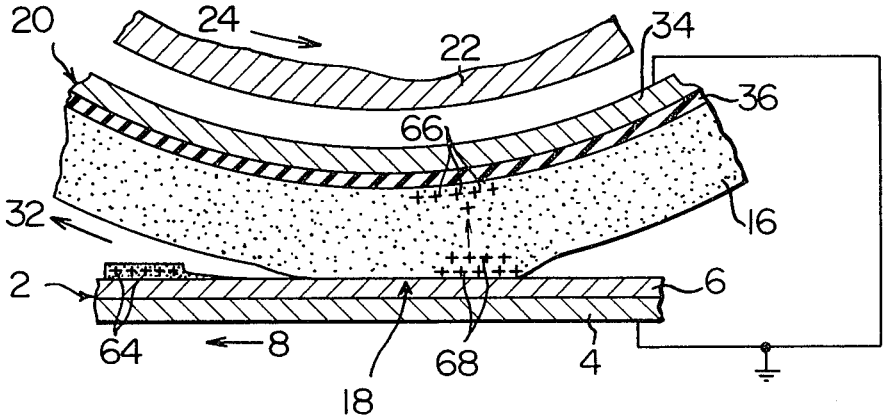

METHOD AND APPARATUS FOR DEVELOPING LATENT ELECTROSTATIC IMAGES

FIELD OF THE INVENTION

This invention relates to a method and apparatus for developing a latent electrostatic image using a powdery developer, and more particularly, to a method and apparatus for developing a latent electrostatic image using a relatively conductive one-component developer.

DESCRIPTION OF THE PRIOR ART

In the method for developing a latent electrostatic image with a powdery developer, the use of a one-component developer containing only toner particles has recently been suggested and gained commercial acceptance in place of the use of a two-component developer containing both toner particles and carrier particles.

The one-component developer is roughly classified into (a) a developer comprising toner particles which can be charged to a certain definite polarity, and therefore, are relatively non-conductive, and (b) a developer comprising relatively conductive toner particles.

A method involving the use of the developer (a) is disclosed, for example, in U.S. Pat. Nos. 3,093,039 and 3,645,770 and Japanese Laid-Open Patent Publication No. 45639/75. In this method, the toner particles are first charged to a specified polarity by rubbing them against a suitable material or applying corona discharge to the toner particles. Then, the toner particles are contacted with the surface of an image-bearing material which carries a latent electrostatic image having a charge of an opposite polarity to the above-specified polarity. Thus, the toner particles are attracted by the surface of the image-bearing material by a Coulomb attracting force acting between the charge of the toner particles and the charge of the latent electrostatic image. This method, however, has a serious defect in that the degree of charging of the toner particles by rubbing or corona discharge varies greatly and depends upon environmental conditions such as temperature or humidity, and therefore, the quality of development of the latent electrostatic image depends greatly on the environmetal conditions. When the toner particles are to be charged by rubbing, the method has a disadvantage in that the degree of charging of the toner particles changes according to the surface condition of the material against which the toner particles are to be rubbed. Thus, when the surface of this material is contaminated or worn out, the amount of charging of the toner particles is reduced drastically. Furthermore, when the toner particles are to be charged by applying a corona discharge thereto, the method has a disadvantage in that the toner particles adhere to and contaminate the discharge electrodes of the corona discharge device, and this reduces the discharge efficiency of the corona discharge device within short periods of time.

On the other hand, the developing method involving the use of the developer (b) is disclosed, for example, in Japanese Patent Publications Nos. 491/62, 492/62 and 20695/63, Japanese Laid-Open Patent Publication No. 5035/74, and U.S. Pat. Nos. 2,976,144; 3,639,245; 3,909,258; and 4,081,571. In this method, the toner particles are directly contacted with the surface of an image-bearing material which carries a latent electrostatic image without going through a step of charging the toner particles to a specified polarity. Thus, in the manner to be described in detail hereinbelow, the toner particles are attracted to the surface. This method is free from the defects of the method using the developer (a), but still has various problems to be solved.

To contact the developer with the surface of the image-bearing material, it is generally necessary, first of all, to retain the developer on the surface of a developer-retaining member composed of a suitable material such as a sleeve or endless belt. When the toner particles constituting the developer are magnetic, the developer can be easily and surely retained on the surface of the developer-retaining member by the action of a magnetic field formed by magnets, as is well known to those skilled in the art. However, the methods disclosed in the above-cited Japanese Patent Publications Nos. 491/62, 492/62 and 20695/63 and U.S. Pat. No. 2,976,144 use a developer composed of non-magnetic toner particles, and therefore, the developer cannot be retained on the surface of the developer-retaining member by the action of a magnetic field. Thus, in these methods, the developer is retained on the surface of the developer-retaining member by the van der Waals' force, etc. However, in this case, the retaining of the developer is very difficult and also unstable, and such methods are still not commercially feasible.

On the other hand, in the methods disclosed in U.S. Pat. Nos. 3,639,245; 3,909,258; and 4,081,571, and Japanese Laid-Open Patent Publication No. 5035/74, a developer composed of magnetic toner particles is used. Accordingly, the developer can be magnetically retained on the surface of the developer-retaining member easily and surely by the action of a magnetic field.

In view of the above fact, the best developing method among those suggested heretofore would be a method which comprises magnetically retaining a one-component developer composed of toner particles which are relatively conductive and are magnetic on the surface of a developer-retaining member, and contacting the developer on the surface of the developer-retaining member with the surface of an image-bearing material which carries a latent electrostatic image.

This developing method considered to be the best among the conventional method still has problems to be solved because of the use of a developer-retaining member which is conductive in its entirety, or has a non-conductive coating on its surface.

In the developing method disclosed in U.S. Pat. No. 3,909,258, a conductive developer-retaining member is used. As is understood from FIG. 4 of U.S. Pat. No. 3,909,258, in this developing method, when relatively conductive toner particles magnetically retained on the surface of a conductive developer-retaining member come close to a latent electrostatic image formed on the surface of an image-bearing material, an electric charge of an opposite polarity to the charge of the latent electrostatic image begins to be injected into the toner particles from the developer-retaining member. When those toner particles on the surface of the developer-retaining member which are located outermost contact the charge of the latent electrostatic image, the charge injected into the toner particles from the developer-retaining member drifts through a plurality of toner particles and arrives at the toner particles which make contact with the charge of the latent electrostatic image. By the attracting action of the two charges, the toner particles are attracted to the surface of the image-bearing material. Of course, the charge of the latent electrostatic image drifts toward the developer-retaining member through toner particles in contact therewith, and therefore, when the time of contact between the toner particles and the latent electrostatic image is prolonged, the two charges are neutralized and the aforesaid attracting action disappears.

In the aforesaid developing method, particularly when the development is carried out at high speeds, the charge is easily injected into the toner particles from the developer-retaining member even if the charge on the image-bearing material has a considerably low potential. Accordingly, the toner particles are attracted to the surface of the image-bearing material considerably faithfully to the potential of the surface of the image-bearing material and therefore with a very high development sensitivity. This markedly high development sensitivity is not desirable in development in a usual electrostatic copying process, and causes the following defects.

When the electrophotographic copying process is the so-called P.P.C. (plain paper copying) process, the image-bearing material is generally a photosensitive material comprising a photoconductive selenium layer or an organic photoconductive layer of polyvinyl carbazole. A latent electrostatic image is formed on the surface of this photosensitive material and developed, and then, the developed image is transferred to plain paper. This procedure is repeatedly performed. Before a latent electrostatic image is formed on the surface of the photosensitive material, it is necessary to perform a step of removing the residual charge and developer left from the previous copying process on the photosensitive material. As is well known to those skilled in the art, it is extremely difficult, or even impossible, to remove the residual charge completely, and generally, even after the performance of the removing step, a charge of about 50 V to about 100 V still remains. In the developing method disclosed in U.S. Pat. No. 3,909,258, the development sensitivity is extremely high. Thus, even when the surface of the photosensitive material has a low potential of from about 50 V to about 100 V, the toner particles are attracted to the surface of the photosensitive material according to this charge. Accordingly, the toner particles are attracted to the surface of the photosensitive material not only by the normal charge of the latent electrostatic image but also by the residual charge described above, and thus cause "background fog" (the phenomenon wherein toner particles are attracted relatively thinly to a nonimage area to which toner particles should not be attracted).

U.S. Pat. No. 4,081,571 discloses the use of a developer-retaining member consisting of a main body made of a conductive material such as aluminum and an insulating coating such as aluminum oxide formed on the surface of the main body. The use of such a developer-retaining member can greatly reduce the background fog as stated in column 6, lines 41 to 44 of the U.S. Pat. No. 4,081,571.

It has been found however that when the developer-retaining member having an insulating coating is used, a "tail effect" (to be described in detail hereinbelow) occurs unless the surface of the developer-retaining member is moved in the same direction as the moving direction of the surface of the image-bearing material on which a latent electrostatic image to be developed is formed and at a speed substantially equal to or higher than the moving speed of the surface of the image-bearing material in the developing zone (in other words, when the developer-retaining member is stationary or is moved relatively slowly).

To achieve good development, it is important, as stated also in the U.S. Pat. No. 4,081,571, to accurately set the distance between the surface of the image-bearing material and the surface of the developer-retaining member at a relatively small value (e.g., about 0.15 to about 0.5 mm). However, if it is desired to move the surface of the developer-retaining member at a relatively high speed in addition to maintaining the accurate setting of the aforesaid distance, tolerances in the machine design will be extremely small. To set the aforesaid distance accurately without drastically reducing machine design tolerances, it is necessary to maintain the surface of the developer-retaining member stationary.

SUMMARY OF THE INVENTION

A primary object of this invention is to provide an improved developing method and apparatus comprises magnetically retaining a relatively conductive one-component developer on the surface of a developer-retaining member, and contacting the developer with the surface of an image-bearing material which has formed thereon a latent electrostatic image, and which can afford the desired excellent developed image without causing a background fog and a tail effect even when the surface of the developer-retaining member is kept stationary.

According to this invention, there is provided a method and apparatus for developing a latent electrostatic image formed on the surface of an image-bearing material by applying a powdery developer thereto, which comprises magnetically retaining a layer of a relatively conductive one-component developer having a resistivity of not more than $10^{13}$ ohms-cm on the surface of a developer-retaining member, and bringing the developer on the surface of the developer-retaining member into contact with the surface of the image-bearing material, characterized in that said developer-retaining member has a resistance, measured by a point-plane resistance measuring method in an environment kept at a temperature of 20° C. and a humidity of 50%, of from $3\times10^{7}$ ohms to $1\times10^{10}$ ohms.

Other objects and advantages of this invention will become apparent from the following description.

BRIEF DESCRIPTION OF THE DRAWINGS

FIGS. 3A and 3B are enlarged sectional views showing a developing zone for illustrating the cause of a "tail effect";

FIG. 4A is a simplified top plan view showing a developed image in which the tail effect occurs; and FIG. 4B is a diagram showing the image density of the developed image shown in FIG. 4A.

DETAILED DESCRIPTION OF PREFERRED EMBODIMENTS

Referring to the accompanying drawings, the developing method and apparatus in accordance with this invention is described in more detail.

Figure 1:
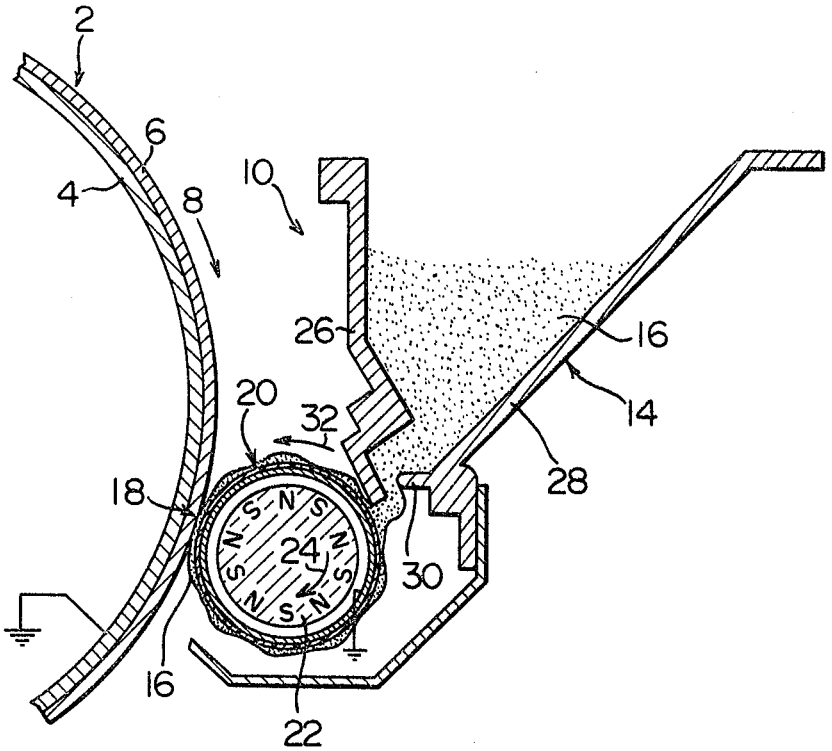
FIG. 1 is a simplified sectional view illustrating the developing method and apparatus of this invention.

Referring to FIG. 1, the image-bearing material in the illustrated embodiment is a cylindrical photosensitive material 2 adapted for rotation in the direction of arrow 8 and consisting of a conductive base layer 4 and a photoconductive layer 6 formed on the base layer. The photoconductive layer 6 may be of any known photoconductive material, such as a photoconductive layer containing ZnO (zinc oxide) and a resin binder, an inorganic photoconductive layer composed mainly of Se (selenium), or an organic photoconductive layer composed mainly of polyvinyl carbazole. If desired, an insulating thin layer (not shown) made of Mylar, for example, may further be provided on the surface of the photoconductive layer 6.

A latent electrostatic image is formed on the surface of the photoconductive material 2 by suitable methods kown per se including the application of corona discharge and the imagewise exposure of the material. The latent electrostatic image is developed with a powdery developer by the action of a developing device generally shown at 10.

The developing device 10 used conveniently for performing the developing method and apparatus of this invention comprises a developer-retaining member and a developer-supplying receptacle 14 for supplying a one-component developer 16, consisting only of toner particles, to the surface of the developer-retaining member. The developer-retaining member in the illustrated embodiment is formed of a stationary sleeve 20 disposed so that its surface approaches the surface of the photosensitive material 2 in a developing zone 18. Within the sleeve 20 is disposed a rotary magnet 22 to be rotated in the direction of arrow 24. Preferably, the magnet 22 is a roll-like permenent magnet having a plurality of poles (10 poles in the drawing) of opposite polarities arranged alternately on its periphery.

The developer supplying receptacle 14 is formed of a front wall 26, a rear wall 28 and two side walls (not shown), and an outlet opening for the developer 16 within the receptacle 14 is defined between the lower end of the front wall 26 and the lower end of the rear wall 28. At the lower end portion of the rear wall 28, a projection 30 is formed so as to extend substantially horizontally toward the front wall 26. The projection 30 serves to adjust the amount of the developer flowing through the outlet opening to the desired value and to prevent the flowing of a large quantity of the developer from the supplying receptacle 14. On the other hand, the lower end of the front wall 26 approaches the surface of the sleeve 20 with a predetermined distance between them, and acts as a doctor blade for adjusting the thickness of the developer layer retained on the surface of the sleeve 20 to a predetermined value.

In the above-described developing device 10, a controlled amount of the developer 16 is supplied to the surface of the sleeve 20 from the outlet opening of the supplying receptacle 14, and is magnetically retained on the surface of the sleeve 20 by the action of a magnetic field formed by the magnet 22. The developer 16 retained magnetically on the surface of the sleeve 20 is moved on the surface of the sleeve 20 in the direction shown by arrow 32 which is opposite to the rotating direction of the magnet 22 by the rotation of the magnet 22 in the direction shown by arrow 24. Thus, the developer 16 successively makes contact with the surface of the photosensitive material rotated in the direction shown by arrow 8 to develop the latent electrostatic image formed on the surface of the photosensitive material 2 successively with the developer 16.

Experiments of the present inventors show that generally, the distance between the surface of the sleeve 20 and the lower end of the front wall 26 of the receptacle 14, which acts as a doctor blade in the developing device 10 shown in FIG. 1, is preferably from 0.2 to 0.5. However, the distance varies somewhat according to the resistivity, flowability, size, etc. of the toner particles which constitute the developer 16. The rotating speed of the magnet 22 is preferably from about 500 to about 1,500 rpm if, for example, the intensity of the magnetic field on the surface of the sleeve 20 is 1000 gauss. The distance between the surface of the photosensitive material and the surface of the sleeve is preferably from about 0.3 to about 0.7 mm at a point where both surfaces are closest to each other. When all of the aforesaid conditions are satisfied, the developer 16 retained on the surface of the sleeve 20 contacts the surface of the photosensitive material relatively lightly.

According to the developing method and apparatus of this invention, the developer 16 used in the developing device 10 is a one-component developer composed only of magnetic toner particles which can be magnetically retained on the surface of the sleeve 20 by the action of a magnetic field generated by the magnet 22. The developer 16, and therefore the toner particles, are relatively conductive, and have a resistivity of not more than $10^{13}$ ohms-cm, and preferably not more than $5\times10^{11}$ ohms-cm. The developer 16 used in the developing method of this invention is known per se, and can be produced, for example, by the method described in U.S. Pat. No. 3,639,245, Japanese Laid-Open Patent Publication No. 5035/74, or Japanese Laid-Open Patent Publication No. 52639/77.

In the developing method of this invention, it is important that the developer-retaining member (which is the sleeve 20 in the illustrated embodiment) should have a resistance, measured by a point-plane resistance measuring method to be described hereinbelow with reference to FIG. 2, of from $3\times10^{7}$ ohms to $1\times10^{10}$ ohms, and preferably from $5\times10^{7}$ ohms to $5\times10^{8}$ ohms, in an environment held at a temperature of 20° C. and a humidity of 50%.

Such a developer-retaining member can be produced by forming a surface layer having a suitable resistance value on a sleeve composed of a main body of aluminum and an aluminum oxide layer thereon.

The surface layer can be conveniently formed by dispersing a carbon black powder in a suitable synthetic resin material, coating the resulting viscous composition on the aluminum oxide layer, and drying the coating. The resistance of the developer-retaining member measured by the aforesaid point-plane resistance measuring method can be properly controlled, for example, by changing the amount of carbon black dispersed in the synthetic resin material.

The developer-retaining member used in the developing method of this invention can also be produced by directly forming a surface layer having a suitable resistance value, for example a synthetic resin surface layer containing carbon black powder dispersed therein formed as above, on the surface of a main body made of aluminum, stainless steel or the like.

Figure 2:
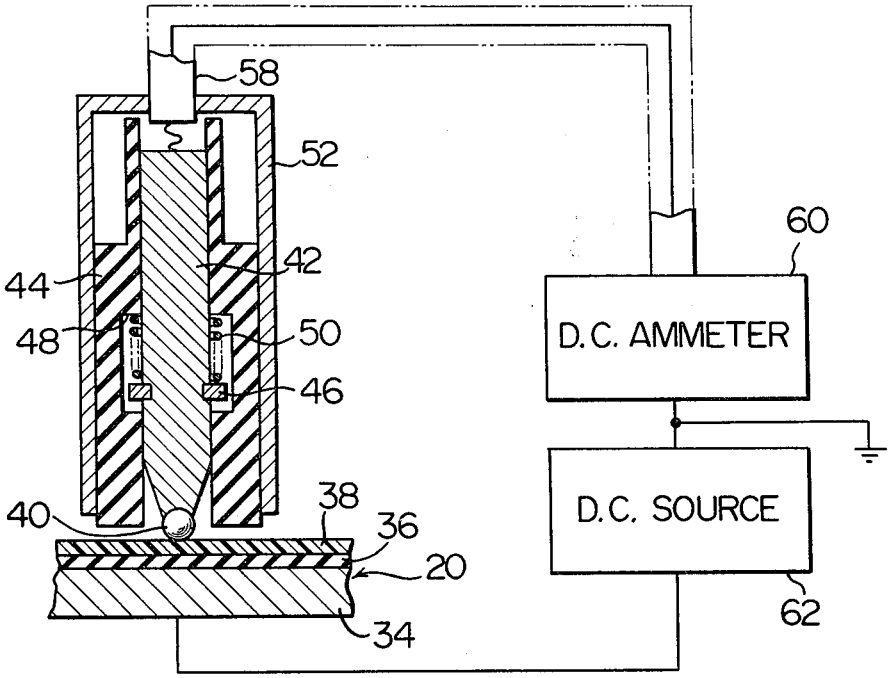
FIG. 2 is a simplified sectional view showing a method for measuring the point-plane resistance of a developer-retaining member.
Figure 2:
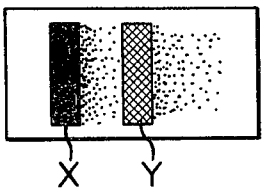
Figure 2:
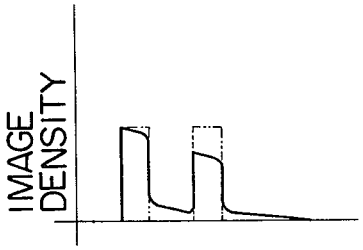

Now, referring to FIG. 2, the point-plane resistance measuring method for the developer-retaining member is described.

For example, to measure the point-plane resistance of a developer-retaining member 20 composed of a main body 34 comprising a conductive material such as aluminum, an insulating interlayer 36 comprising, for example, aluminum oxide, and a synthetic resin surface layer 38 containing carbon black powder dispersed therein, it is first necessary to contact an electrode 40, comprising a steel ball having a diameter of about 0.5 mm, with the surface of the developer-retaining member 20. The electrode 40 is disposed in a semispherical depression formed at the lower end of a steel conducting rod 42. The conducting rod 42 is fitted within a generally cylindrical insulator 44 so that it is vertically movable up and down. A coil spring 50 is interposed between a washer 46 secured to the conducting rod 42 and a shoulder portion 48 formed in the inside surface of the insulator 44. The coil spring 50 forces the conducting rod 42 elastically toward the surface of the developer-retaining member 20, and thus urges the electrode 40 against the surface of the developer-retaining member 20 with a force of about 300 g. The side walls and top end of the insulator 44 are surrounded by a shield case 52 to prevent measurement instabilities which may be caused by electric noises. The conducting rod 42 is connected to a D.C. ammeter 60 through a coaxial cable 58, and the D.C. ammeter 60 is connected to the conductive main body 34 of the developer-retaining member 20 through a D.C. source 62 of 100 V.

In the circuit shown in FIG. 2, the current value i detected by the D.C. ammeter is measured, and from it, $R=(100/i)$ is calculated. R thus calculated represents the resistance between the electrode 40 comprising a steel ball having a diameter of 0.5 mm which is urged against the surface of the developer-retaining member 20 with a force of 300 g and the conductive main body 34 of the developer-retaining member 20 at a time when a voltage of 100 V is applied across the electrode 40 and the main body 34. The resistance value obtained is that of the developer-retaining member 20 measured by the point-plane resistance measuring method as referred to in the present application.

As stated hereinabove, in the developing method of this invention, it is important that the developer-retaining member should have a resistance, measured by the aforesaid point-plane resistance measuring method, of from $3\times10^7$ ohms to $1\times10^{10}$ ohms, preferably from $5\times10^7$ ohms to $5\times10^8$ ohms, and in an environment kept at a temperature of 20° C. and a humidity of 50%.

When a developer-retaining member having a resistance value of less than $3\times10^7$ ohms is used, the development sensitivity is too high and therefore, tends to cause "background fog" as in the developing method disclosed in U.S. Pat. No. 3,909,258 which involves using a conductive developer-retaining member composed only of a conductive main body.

On the other hand, when a developer-retaining member having a resistance value of larger than $1\times10^{11}$ ohms is used, a "tail effect" tends to occur if the developer-retaining member is maintained stationary or moved relatively slowly, as in the developing method disclosed in U.S. Pat. No. 4,081,571 which uses a developer-retaining member composed of a conductive main body and an insulating coating.

According to the method and apparatus of this invention, good development can be achieved as desired without causing the background fog and tail effect by using a developer-retaining member which has a resistance value within a specified range which is between the resistance of the developer-retaining member disclosed in U.S. Pat. No. 3,909,258 and the resistance value of the developer-retaining member disclosed in U.S. Pat. No. 4,081,571.

For better understanding of the advantages of the developing method of this invention, the "tail effect" which occurs when using a developer-retaining member composed of a conductive main body and an insulating coating as in the developer-retaining member disclosed in U.S. Pat. No. 4,081,571 is described below with reference to FIGS. 3-A and 3-B which are enlarged view of a developing zone.

In FIGS. 3-A and 3-B, a photosensitive material 2 composed of a grounded conductive base layer 4 and a photoconductive layer 6 thereon is moved in the direction shown by arrow 8. In the meantime, a sleeve 20 composed of a grounded conductive main body 34 and an insulating coating 36 formed thereon is kept stationary. A developer 16 retained magnetically on the surface of the sleeve 20 is moved in the direction shown by arrow 32 on the surface of the sleeve 20 by the action of a magnet 22 rotating in the direction of arrow 24.

As shown in FIG. 3-A, when, as a result of the movement of the photosensitive material 2 in the direction of arrow 8, a charge 64 of a latent electrostatic image formed on the surface of the photosensitive material 2 reaches a developing zone 18 and makes contact with the developer 16, a part of the charge 64 begins to drift toward the sleeve 20 through the developer 16. The drifting of the charge proceeds gradually while the charge 64 is in contact with the developer 20. The charge which has reached the surface of the sleeve 20 is accumulated there. As shown in FIG. 3-B, the charge 66 which is accumulated on the surface of the sleeve 20 remains for a while on the surface of the sleeve 20 even after the charge 64 which has caused generation of the charge 66 moves past the developing zone 18 and is no longer in contact with the developer 16. In this situation, an electric field generated by the accumulated charge 66 causes the developer 16 to be attracted to the surface of the photosensitive material 2 even at a part upstream of a normal image area where the charge 64 of the latent electrostatic image exists, thus forming an image like the tail of the normal image area. This phenomenon is known in the art as a "tail effect".

The accumulated charge 66 decays with time (the rate of decaying depends upon the impedance of the insulating coating 36 located on the surface of the sleeve 20 and the impedance of the developer 16), and therefore, the tail effect is weaker at a part farther away from the normal image area.

On the other hand, as shown in FIG. 3-B, when the next charge 68 of the latent electrostatic image arrives at the developing zone 18 and makes contact with the developer 16 before the accumulated charge 66 decays sufficiently, the potential difference between the surface of the sleeve 20 and the surface of the photosensitive material 2 decreases corresponding to the accumulated charge 66. Consequently, the density of the developer attracted to the image area having the charge 68 on the photosensitive material 2 becomes lower. This phenomenon which causes a decrease in the density of the normal image area can also be regarded as a kind of the tail effect.

When the tail effect described above occurs, thinly developed portions shown by dots upstream of normal developed image areas X and Y form as shown in FIG. 4-A. At the same time, the density of the developed imae area Y on the upstream side is reduced. Thus, the developed image density which should normally be as shown by a two-dot chain line in FIG. 4-B becomes the developed image density shown by a solid line in FIG. 4-B.

Since the tail effect occurs by the causes described above, it can be avoided if, in the developing zone 18, the sleeve 20 is moved in the same direction as the moving direction of the photosensitive material 2 and at a speed substantially equal to or somewhat higher than the moving speed of the photosensitive material 2 to move the accumulated charge 66 together with the charge 64 which has caused the charge 66 to form. However, as stated hereinabove, when the sleeve 20 is moved at a relatively high speed, tolerances in machine design are extremely reduced. Accordingly, in many cases, it is desirable for the sleeve 20 to be stationary.

To avoid the tail effect while maintaining the sleeve 20 stationary, it is important to cause the accumulated charge 66 to decay rapidly. Of course, if the sleeve 20 is made only of a conductive main body 34 with the elimination of the insulating coating 36, the charge 66 which has drifted to the surface of the sleeve 20 never builds up there, and the aforesaid tail effect does not occur. This, however, causes background fog as stated hereinabove.

The present inventors have found that if the resistance, measured by the point-plane resistance measuring method in an environment kept at a temperature of 20° C. and a humidity of 50%, of the sleeve 20 is adjusted to $3\times10^7$ ohms to be from $1\times10^{10}$ ohms, and preferably from $5\times10^7$ ohms to $5\times10^8$ ohms, for example, by forming a synthetic resin surface layer containing carbon black particles dispersed therein on the insulating coating 36 of the sleeve 20, or by forming the synthetic resin layer directly on the conductive main body 34 of the sleeve 20 without using the insulating coating 36, the accumulated charge 66 can be rapidly caused to decay and the tail effect can be avoided, and moreover, the background fog can be prevented.

The accumulated electric charge 66 can also be rapidly caused to decay by markedly reducing the resistivity of the developer. However, when the resistivity of the developer is markedly decreased, it is extremely difficult to transfer an image developed with the developer, as is well known to those skilled in the art. Accordingly, the use of a developer having a very low resistivity is undesirable during development in an electrophotographic copying process including the transfer of a developed image.

Specific examples are given below to illustrate the invention more specifically.

EXAMPLE I

Five sleeves were provided each of which consisted of a main body of aluminum and an aluminum oxide layer formed on the main body by anodization. The surface of each of the five sleeves was uniformly coated with each of viscous compositions Nos. 1 to 5 containing the substances shown in Table 1 below, and then dried at 60° C. for more than 30 minutes in a hot air-circulating oven to produce sleeves Nos. 1 to 5 each having a surface layer on top of the aluminum oxide layer.

TABLE 1

| | Viscous composition | | | | |
|---|---|---|---|---|---|
| | No. 1 | No. 2 | No. 3 | No. 4 | No. 5 |
| Special Black No. 4 | 0.5 g. | 0.5 g | 0.5 g | 0.5 g | 0 g |
| Oil Black HBB | 0.05 g | 0.05 g | 0.05 g | 0.05 g | 0.05 g |

TABLE 1-continued

| | Viscous composition | | | | |
|---|---|---|---|---|---|
| | No. 1 | No. 2 | No. 3 | No. 4 | No. 5 |
| T.H.F. (total) | 20 g | 20 g | 20 g | 20 g | 20 g |
| Denka LAC 21K | 12.5 g | 10 g | 8 g | 6 g | 5 g |

Each of the viscous compositions Nos. 1 to 5 was prepared in the following manner.

First, Special Black No. 4 (carbon black powder, a product of Degusa Corporation) and Oil Black HBB (an oil-soluble dye produced by Orient Chemical Co., Ltd.) were weighed into a 500 ml. plastic container. Then, T.H.F. (tetrahydrofuran) was added. The materials were dispersed for about 3 minutes by means of an ultrasonic disperser. Denka LAC 21K (a vinyl chloride copolymer having a solids content of 40%, a product of Denki Kagaku Kogyo Co., Ltd.) was put into the dispersion, and dispersed by ultrasonic vibration for another 3 minutes or so. After the dispersion, THF in an amount about 60% of that of THF initially added was added, and the mixture was stirred. Thus, each of the viscous compositions Nos. 1 to 5 was prepared.

The resistances of the sleeves Nos. 1 to 5 were measured by the point-plane resistance measuring method described above with reference to FIG. 2. The results are tabulated in Table 2.

TABLE 2

| Measuring environment (temperature, humidity) | Resistances (ohms) of the sleeves | | | | |
|---|---|---|---|---|---|
| | No. 1 | No. 2 | No. 3 | No. 4 | No. 5 |
| 23° C., 85% | $5\times10^9$ | $5\times10^8$ | $1.2\times10^8$ | $1\times10^7$ | $2\times10^{12}$ |
| 28° C., 50% | $1\times10^{10}$ | $7\times10^8$ | $1.5\times10^8$ | $1.3\times10^7$ | $9\times10^{11}$ |
| 36° C., 24% | $2\times10^{10}$ | $1\times10^9$ | $2\times10^8$ | $3\times10^7$ | $8\times10^{10}$ |

Each of the sleeves Nos. 1 to 5 was used as a developer-retaining member in a developing device of the type shown in FIG. 1, and a latent electrostatic image formed on the surface of an image-bearing material consisting of a base of aluminum and a photoconductive layer containing ZnO and a resin binder was developed. The developer used was a relatively conductive one—composed developer composed only of toner particles having a resistivity of about $5\times10^{10}$ ohms-cm.

When the sleeve No. 5 was used, a tail effect occurred both at a low humidity and a high humidity.

When sleeve No. 1 was used, the tail effect did not occur in the initial stage at a humidity of 50%, but after continuously repeating the development several tens of times, a slight degree of tail effect began to occur. This is presumably because the temperature of the sleeve rose during the repetition of development and this caused an increase in the resistance of the sleeve.

When sleeve No. 2 was used, a very slight degree of tail effect occurred at a low humidity of less than about 20% after continuously repeating the development about 500 times.

When sleeve No. 3 was used, neither the tail effect nor the background fog occurred at all even after repeating the development several thousand times in various environments.

When sleeve No. 4 was used, no tail effect occurred. However, in environments other than low humidity environments, background fog occurred after repeating the development about 100 times.

It is understood from the above results that if there is used a developer-retaining member having a resistance of from $3\times10^7$ ohms to $1\times10^{10}$ ohms, and preferably $5\times10^7$ to $5\times10^8$ ohms, in an environment kept at a temperature of 20° C. and a humidity of 50%, which is considered to be an average environment in an electrostatic copying apparatus, good development can be achieved without causing a tail effect or background fog.

EXAMPLE II

Sleeves composed only of a main body of aluminum were provided. The following ingredients were treated in the same way as in Example I to form viscous compositions.

| | |
|---|---|
| Special Black No. 4 | 1 g |
| Oil Black HBB | 0.1 g |
| THF | 45–50 g |
| Denka LAC 21K | 40 g |

The viscous compositions were each applied to the surface of each of the sleeves to form a surface layer. The resistances of the sleeves so produced were $1\times10^8$ ohms to $3\times10^8$ ohms under the three environments described in Table 2. Using each of these sleeves as a developer-retaining member, a latent electrostatic image was developed in the same way as in Example I. Good results were obtained.

EXAMPLE III

Sleeves composed only of a main body of stainless steel were provided. The following ingredients were treated in the same way as in Example I to form viscous compositions.

| | |
|---|---|
| Special Black No. 4 | 1 g |
| Oil Black | 0.1 g |
| THF | 45–50 g |
| AROTAP 3211 (solids content 50%) | 32 g |

The viscous compositions were each applied to the surface of each of the sleeves to form a surface layer. The AROTAP 3211 was used instead of Denka LAC K21 to secure good adhesion to the stainless steel main body.

The resistances of the resulting sleeves under the three environments described in Table 2 were $1\times10^8$ ohms to $3\times10^8$ ohms.

When a latent electrostatic image was developed in the same way as in Example I using each of these sleeves as a developer-retaining member, good results were obtained.

It was found that a rise in temperature during repetition of development is smaller in the sleeves composed of stainless steel used as a main body than in the sleeves composed of aluminum used as a main body. This is presumably because the magnitude of the eddy current formed by the alternating magnetic field generated by the rotation of the magnet is smaller in the stainless steel main body than in the aluminum main body.

Accordingly, the use of a sleeve composed of stainless steel as a main body is preferred when the image-bearing material or developer is likely to be adversely affected even by relatively low temperatures of, say, about 40° C.

EXAMPLE IV

Two sleeves consisting of a main body of aluminum and an aluminum oxide layer formed thereon by anodization were provided. Carbon black was coated on the surfaces of these sleeves using the cores of marketed pencils. Then, the surface of each sleeve was rubbed with a wad impregnated with alcohol to remove coating unevenness and adjust the amount of the coated carbon black. A first sleeve having a resistance at a temperature of 20° C. and a humidity of 50% of $1\times10^4$ ohms and a second sleeve having a resistance of $0.5\times10^7$ ohms at a temperature of 20° C. and a humidity of 50% were thus produced.

Using the first sleeve as a developer-retaining member, a latent electrostatic image was developed in the same way as in Example I. After repeating the development several tens of times, considerable fog appeared in the background area.

When a latent electrostatic image was developed in the same way as in Example I using the second sleeve as a developer-retaining member, some background occurred after repeating the development about 100 times at a high humidity (temperature 20° C., humidity 82%).

EXAMPLE V

A latent electrostatic image was developed in the same way as in Example I using a sleeve consisting of a main body of aluminum and an aluminum oxide layer formed thereon by anodization as a developer-retaining member. It was consequently found that a considerable tail effect occurred at low humidities.

What we claim is:

1. A method for developing a latent electrostatic image formed on the surface of an image-bearing material by applying a powdery developer thereto, which comprises magnetically retaining a layer of a relatively conductive one-component developer having a resistivity of not more than $10^{13}$ ohms-cmm on the surface of a developer-retaining member, and bringing the developer on the surface of the developer-retaining member into contact with the surface of the image-bearing material, characterized in that said developer-retaining member has a resistance, measured by a point-plane resistance measuring method in an environment kept at a temperature of 20° C. and a humidity of 50%, of $3\times10^7$ ohms to $1\times10^{10}$ ohms.

2. The method of claim 1 wherein said resistance is $5\times10^7$ to $5\times10^8$ ohms.

3. The method of claim 2, wherein said developer-retaining member comprises a stationary sleeve having disposed therein a rotary permanent magnet having a plurality of poles of opposite polarities arranged alternately on its periphery, wherein the developer is retained on the surface of the sleeve by the action of a magnetic field formed by said magnet.

4. The method of claim 1, wherein said developer-retaining member comprises a stationary sleeve having disposed therein a rotary permanent magnet having a plurality of poles of opposite polarities arranged alternately on its periphery, wherein the developer is retained on the surface of the sleeve by the action of a magnetic field formed by said magnet.

5. The method of claim 4, wherein in a developing zone in which the developer makes contact with the surface of the image-bearing material, the surface of the image-bearing material is continuously moved in a predetermined direction, and wherein said magnet is moved in a direction opposite to said predetermined direction, whereby the developer is moved on the surface of the sleeve in said predetermined direction.

6. The method of claims 4 or 5 or 3 wherein said sleeve comprises a main body of aluminum, an aluminum oxide layer on the main body, and a surface layer of a synthetic resin containing carbon black powder dispersed therein.

7. The method of claim 4 or 5 or 3 wherein said sleeve comprises a main body of aluminum and a surface layer of a synthetic resin containing carbon black powder dispersed therein.

8. The method of claim 4 or 5 or 3 wherein said sleeve comprises a main body of stainless steel and a surface layer of a synthetic resin containing carbon black powder dispersed therein.

9. The method of claims 1, 2, 4, 5, 3, wherein said developer has a resistivity of not more than $5\times10^{11}$ ohms-cm.

10. The method of claim 9, wherein in a developing zone in which the developer makes contact with the surface of the image-bearing material, the surface of the image-bearing material is continuously moved in a predetermined direction, and wherein said magnet is moved in a direction opposite to said predetermined direction, whereby the developer is moved on the surface of the sleeve in said predetermined direction.

* * * * *